United States Patent [19]

Chern

[11] 4,321,718

[45] Mar. 30, 1982

[54] BABY PILLOW

[76] Inventor: Yenn J. Chern, 8, Lane 24, Hsin Kao Rd., Hsin Kwan Tsun, Tai Pin Hsiang, Taichung, Taiwan

[21] Appl. No.: 214,521

[22] Filed: Dec. 9, 1980

[51] Int. Cl.[3] ..... A47G 9/00

[52] U.S. Cl. ..... 5/437; 5/440; 269/328; 297/391

[58] Field of Search ..... 5/437, 440, 424; 269/328; 128/134; 297/391, 464

[56] References Cited

U.S. PATENT DOCUMENTS 3,650,523 3/1972 Darby, Jr. ..... 128/134

3,957,262 5/1976 McReynolds ..... 5/437

4,045,678 8/1977 Rickard ..... 269/328

*Primary Examiner*—Alexander Grosz

*Attorney, Agent, or Firm*—Knobbe, Martens, Olson, Hubbard & Bear

[57] ABSTRACT

This invention relates to a baby pillow comprising a support board with two cases on both ends, two protection boards connected with the cases by means of screws, two side cushions bound onto the protection boards, and a base cushion between the cases and under the side cushions, characterized in that the space constituted by the side cushions is adjustable by means of the screws, and the baby's head may be held in place between the side cushions during its sleep.

1 Claim, 2 Drawing Figures

BABY PILLOW

BACKGROUND OF THE PRESENT INVENTION

It is the inventor's best knowledge that there has been not yet any pillow specifically designed for the baby. To prevent the baby from sleeping in a position other than the normal one, the parents usually stuff some soft materials around the baby's head. The ill ventilation will therefore make the baby subject to prickly heat. Furthermore, if the baby does not sleep in a normal position, chances are that its skull will develop into an unexpected shape.

SUMMARY OF THE PRESENT INVENTION

This invention relates to a baby pillow with which the baby's head may be held in place by means of the side cushions.

One objective of the present invention is to provide a baby pillow which may prevent the baby from sleeping in a position other than the normal one so as to lead the baby's skull into a sound bone development.

Another objective of the present invention is to provide a baby pillow which offers a wider space for the ear portions while the baby's temple and cheeks are held in place, so that a ventilative effect will be attained around the baby's ears.

Still another objective of the present invention is to provide a baby pillow in that the space constituted by the side cushions is adjustable by means of the screws so that the baby pillow according to the present invention suits variable sizes of babys' heads.

The present invention will be further described with reference to the accompanying drawings, the description being given by way of example only, not by way of limitation.

BRIEF DESCRIPTION OF THE INVENTION

FIG. 1 is a prospective view of a preferred embodiment according to the present invention; and FIG. 2 is a front elevation of a preferred embodiment according to the present invention, wherein a base cushion and two side cushions are taken away, and the dotted portions depict the positions where the screws extend more inwardly.

DETAILED DESCRIPTION OF THE PRESENT INVENTION

Figure 1:
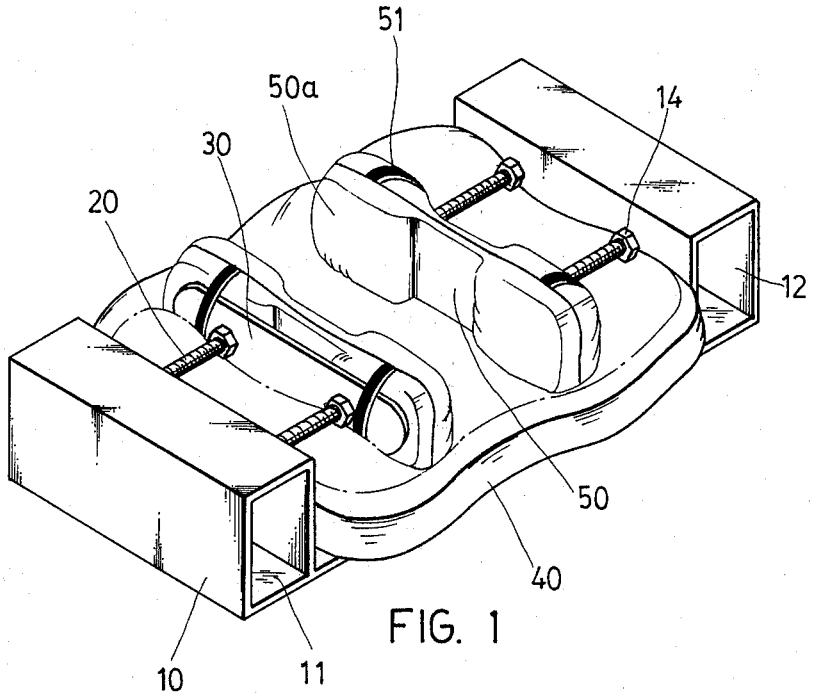
Figure 2:
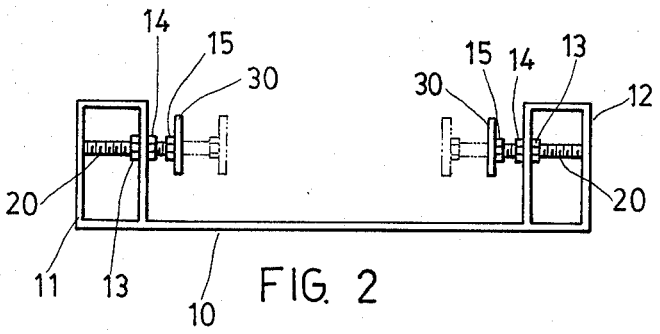

Referring to FIG. 1, indicated at numeral 10 is a support board. On both sides of the support board 10 are two hollow cases 11 and 12, each having two open ends. In a preferred embodiment of the present invention, each of the cases 11 and 12 is provided with two male screws 20. The male screws 20 are penetrated through the vertical inner sides of the cases 11 and 12. The length of the male screws 20 extending inward is adjustable; after it is set, each male screw 20 may be fastened by means of two female screws 13 and 14. Either referring to FIG. 1 or FIG. 2, onto the free ends of each parallel pair of male screws 20 is provided a protection board 30. The protection board 30 is fixed onto the male screws 20 and fastened thereon by means of the female screws 15.

As shown in FIG. 1, a side cushion 50 has two protrusions 50*a* thrusting horizontally toward the middle of the support board 10. At the back of the side cushion 50, there are provided two elastic bands 51. The side cushions 50 are bound to the protection boards 30 by means of the elastic bands 51. In applying the present invention, two side cushions 50 constitute a wider space in the middle portion for baby's ears. Baby's temple and cheeks are respectively held in place by means of the protrusions 50*a* of the side cushions 50. Also as shown in FIG. 1, a base cushion 40 is put under the male screws 20, the protection boards 30 and side cushions 50, and between the case 11 and 12.

During the active period of bone growth, the baby requires a greater care. If it sleeps in a position other than a normal one, chances are that its skull will develop into an unexpected shape. With the application of the present invention, the baby's head may be held in place during sleep. In other words, the present invention may lead the baby's skull into a sound bone development.

It is to be understood that the foregoing disclosure is given by way of illustrative example only, rather than by way of limitation, and that without departing from the principle and scope of the invention, the details may be varied within the scope of the appended claims.

What I claim is:

1. A baby pillow comprising:

a support board provided with two hollow cases, one on each end thereof, two protection boards, one connected with each of said hollow cases by means of screws through said cases, each screw having one end hidden in said cases;

two side cushions, one releasably bound onto each of said protection boards, each side cushion having two protrusions, one at each end thereof; and a base cushion put upon said support board whereby a space constituted between said side cushions is adjustable by means of said screws, and a baby's head may be held in place between said side cushions with the baby's ear on each side being positioned between the protrusions on the side cushion on each side.

* * * * *